US006857134B1

(12) United States Patent
Cowell

(10) Patent No.: US 6,857,134 B1
(45) Date of Patent: Feb. 22, 2005

(54) PERSONAL COOLING DEVICE

(76) Inventor: Jed Cowell, 7978 Curleybark Cove., Bartlett, TN (US) 38135

( * ) Notice: Subject to any disclaimer, the term of this patent is extended or adjusted under 35 U.S.C. 154(b) by 16 days.

(21) Appl. No.: 10/320,915

(22) Filed: Dec. 17, 2002

(51) Int. Cl.[7] ..... A42B 1/24
(52) U.S. Cl. ..... 2/209.13; 224/181
(58) Field of Search ..... 2/209.13, 195.1–195.4, 2/175.6, 171.2; 224/181, 148.5, 414, 275, 901.4, 901.6, 575, 576; 607/109, 110; 383/110, 84, 13, 86, 6, 11, 901, 902, 15, 16, 22, 23, 26; 62/331

(56) References Cited

U.S. PATENT DOCUMENTS 3,207,420 A * 9/1965 Navarette-Kindelan ..... 229/56
4,180,868 A * 1/1980 Snow ..... 2/203
4,381,025 A * 4/1983 Schooley ..... 150/2.4
4,854,319 A * 8/1989 Tobin ..... 607/109
4,958,635 A * 9/1990 Roberts ..... 128/403
5,216,900 A * 6/1993 Jones ..... 62/457.2
5,327,585 A * 7/1994 Karlan ..... 2/7
5,605,144 A * 2/1997 Simmons et al. ..... 126/204
6,021,525 A * 2/2000 Mertins ..... 2/172
6,481,021 B2 * 11/2002 Spell ..... 2/209.13

* cited by examiner

*Primary Examiner*—Katherine Moran
(74) *Attorney, Agent, or Firm*—Wyatt, Tarrant & Combs, L.L.P.

(57) ABSTRACT

A personal cooling device adapted for suspension from the rear strap of a cap. The device includes an elongated pouch member configured to hold a coolant pack, and a suspension member extended above an open upper end of a second side of the pouch. Fastening means are provided such that the suspension means can be looped over the strap of the cap and secured to the pouch, thereby securing the pouch on the cap. A second suspension member, extending from a side of the pouch, can be used to hang the device from a cap in a horizontal configuration. A coolant pack enclosed in the pouch cools the user. To prevent pooling of coolant gel, the coolant pack preferably has a plurality of closed compartments. The device can be used in an exchange system in which warm packs are replaced with frozen packs, such as for a rental fee.

16 Claims, 6 Drawing Sheets

PERSONAL COOLING DEVICE

CROSS REFERENCE TO RELATED APPLICATIONS

Not applicable

STATEMENT REGARDING FEDERALLY SPONSORED RESEARCH OR DEVELOPMENT

Not applicable

REFERENCE TO A MICROFICHE APPENDIX

Not applicable

FIELD OF THE INVENTION

The present invention relates to cooling devices, and more particularly to mobile cooling devices designed for individual users.

BACKGROUND OF THE INVENTION

Efforts have been made to provide personal cooling devices that can be worn by a user to provide a cooling effect during hot weather. However, prior art personal cooling devices suffer from a combination of the following drawbacks: (1) short duration of cooling effect; (2) lack of portability; (3) lack of ability to keep coolant in a targeted area; (4) high cost of manufacture; (5) lack of a means for convenient storage when not in use; (6) lack of means for advertising media; (7) lack of hygienically acceptable means of public re-use or recycling; (8) requires access to a cooling media that may not be stored practically or that is not ready available under some conditions (e.g. ice in remote locations).

Baseball-type caps are the most ubiquitous form of hat presently being worn in the United States. Most baseball hats have an opening in the rear of the hat, with a strap spanning the opening along the rim of the hat. In most cases the strap is adjustable, such that the size of the rim of the hat can be adjusted to fit various head sizes.

Various efforts have been made to provide neck shields that extend downward from the rear of a hat or helmet. See U.S. Pat. No. 6,233,745 (Friesen); U.S. Pat. No. 6,163,886 (Carter); U.S. Pat. No. 5,493,734 (Nieves-Rivera); U.S. Pat. No. 5,201,077 (Dondlinger).

U.S. Pat. No. 6,021,525 (Mertins) discloses a neck shield that hangs downward from the rear strap of a cap. The neck shield includes a securement loop portion for securing the attachment to the adjustment strap of the cap. A connector portion has first and second ends and diverging side edges between the first and second ends, the first end being secured to the securement loop forming portion. A deployable neck shield portion is connected to the second end of the connector portion. The connector portion is shaped such that when stowed inside the cap, the connector portion fills the hemispheric opening. When deployed, the connector portion positions the demployable neck shield in position to protect the user's neck from sun rays. The inside surface of the connector portion can carry decorative surface ornamentation, such as a team logo. When in a stowed position, the decorative surface ornamentation is presented for viewing. Mertins makes no mention of using ice or coolant packs in conjunction with the neck shield or cap.

Efforts have been made to provide caps that include some form of cooling function. U.S. Pat. Des. No. 358,474 discloses a cap that has what appears to be an ice compartment on the rear region of the cap. The compartment is located above the rim of the hat, and is apparently not removable. U.S. Pat. No. 5,327,585 (Karlan) discloses an elongated, semi-flat tubular body that may be removably supported within the channel defined by the sweat band of a hat or cap for use in absorbing heat from the adjacent head areas of the wearer of the hat or to provide heat to those, adjacent head areas. The elongated, semi-flat tubular body is constructed of flexible fluid impervious material and is divided into separate longitudinally spaced compartments along longitudinally spaced flexible transverse zones of the body. The compartments are filled with a fluid eutectic solution. The body may be folded along the transverse zones for relative angular displacement of the adjacent compartments.

As far as the inventor can determine, U.S. Pat. No. 6,185,750 (Dumas) is the only prior effort to use the rear strap of a cap as a means of supporting a cooling device. The cooling device of Dumas comprises a narrow pouch configured to fit around the neck of a user. The pouch has an interior portion and a fastening means that securely fits the device around the user's neck. The cooling device has a cap attachment means that allows the cooling device to be secured to the user's cap. The pouch is filled with ice, which cools the air around the user.

As far as the inventor has been able to determine, no efforts have been made to combine neck shields with coolant technology in order to provide a personal cooling device. There is thus a need for an invention having the following characteristics and advantages over the prior art.

OBJECTS AND SUMMARY OF THE INVENTION

It is an object of the invention to provide a cooling device for the body of a user that is portable, reusable, hygienic and inexpensive to manufacture, and that can be readily replenished with a readily available coolant in order to provide a continuous cooling sensation.

The personal cooling device of the invention is used with a cap, such as a baseball cap or visor, having a strap extending across a rear region of the rim of the cap. The personal cooling device includes an elongated pouch member configured to hold a coolant pack. The pouch has an open upper end and first and second opposing sides. The first and the second opposing sides have a flattened configuration.

A suspension member extends above the open upper end of the second side of the pouch. The pouch has a fist fastening means fixed on an outer surface of the first side of the pouch, adjacent the open upper end. A second fastening means is fixed on an inner surface of the suspension member. The first and second fastening means are configured to selectively attach to one another. The second fastening means is positioned such that when the second fastening means attaches to the first fastening means, the suspension member forms a loop of sufficient length to suspend the pouch from the cap via the strap of the cap, or in the alternative may be attached to the strap or cap (particularly if no strap) by cooperating fastening means on the cap and suspension member.

To provide a means for easy storage when not in use, a third fastening means, attachable to the second fastening means, can be fixed on an outer surface of the second side of the pouch for use in securing the pouch in a rolled up configuration.

In an alternative embodiment, a second suspension member is provided for use in hanging the device from a cap in a horizontal configuration. The second suspension member extends from a middle portion of the pouch between the first and the second sides of the pouch. A fourth and a fifth fastening means are provided for use in hanging the pouch from a cap in a horizontal configuration.

To prevent pooling of coolant gel, the coolant pack preferably has a quilted configuration consisting of a plurality of closed compartments. Each closed compartment encapsulates an amount of coolant, thus preventing the coolant from pooling in a lower portion of the coolant pack upon warming of the coolant. The closed compartments are preferably arranged in a pair of side-by-side vertical columns. In a preferred embodiment, an inner side of the coolant pack is composed of a heat conductive material, while an outer side of the coolant pack has a reflective coating. The conductive side facilitates transfer of heat from the user to the coolant. The reflective coating reflects sun rays, thus slowing down the rate at which the coolant pack warms up during use.

Methods of using the personal cooling devices are disclosed. The methods include an exchange system for use at public events, such as sporting events or music festivals. In the exchange system, multiple coolant packs are distributed from a vending location for use in the elongated pouches. When a coolant pack warms up and no longer provides a cooling sensation, a user can return the warm pack to the vending location and exchange it for a frozen coolant pack. The vendor can charge a fee for the new frozen pack, or distribute it free of charge for promotional purposes. When used in an exchange system, the coolant packs are preferably distributed in a poly bag, in order to promote hygienic exchange of the coolant packs.

The foregoing and other objects, features, aspects and advantages of the invention will become more apparent from the following detailed description of the invention when considered in conjunction with the accompanying drawings.

PREFERRED EMBODIMENTS OF THE INVENTION

In the following detailed description of the preferred embodiments, reference is made to the accompanying drawings which form a part hereof, and in which are shown by way of illustration specific embodiments in which the invention may be practiced. It is to be understood that other embodiments maybe utilized and structural changes maybe made without departing from the scope of the present invention.

Figure 1:
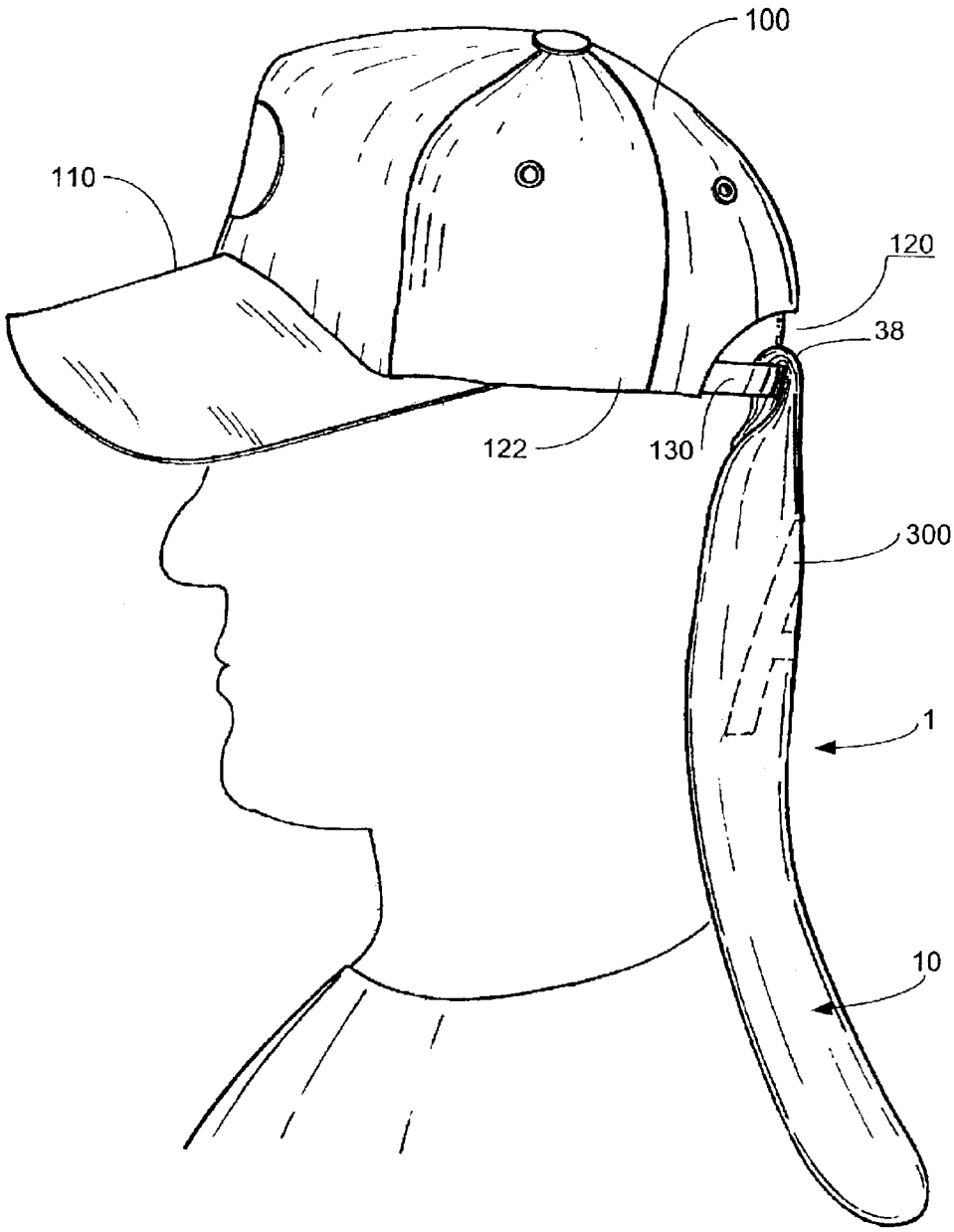
FIG. 1 is a side perspective view of one preferred embodiment of the personal cooling device of the invention suspended from the rear strap of a cap of a user of the device.

As shown in FIG. 1, the personal cooling device of the invention 1 is designed for use with a cap 100, such as a baseball cap 100 or a visor. As shown most clearly in FIG. 2, the cap 100 has a rear opening 120 and a strap 130 extending across a rim region 122 of the rear opening 120. Those skilled in the art will recognize that some embodiments of caps do not include a rear opening 120 and an exposed strap 130 extending across the opening. In such embodiments, the alternative attachment means may be utilized as hereinafter described.

Figure 4:
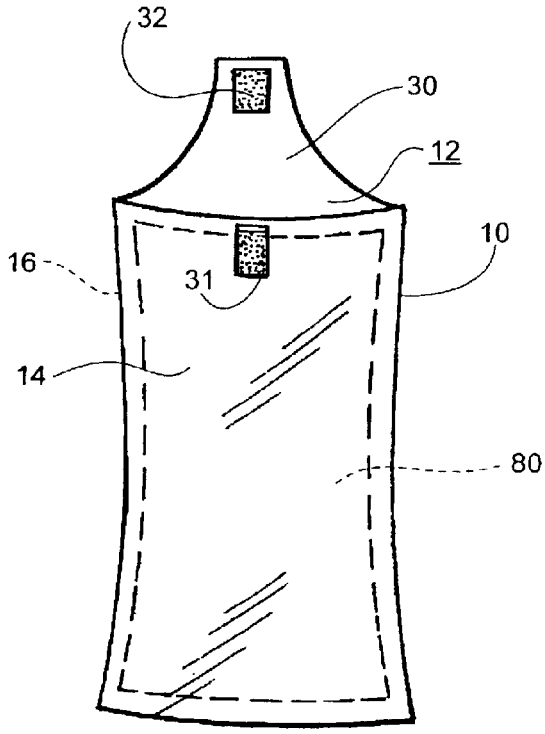
FIG. 4 is a frontal view of a first side of the personal cooling device, featuring a phantom line view of a coolant pack housed inside of the pouch component of the device.
Figure 5:
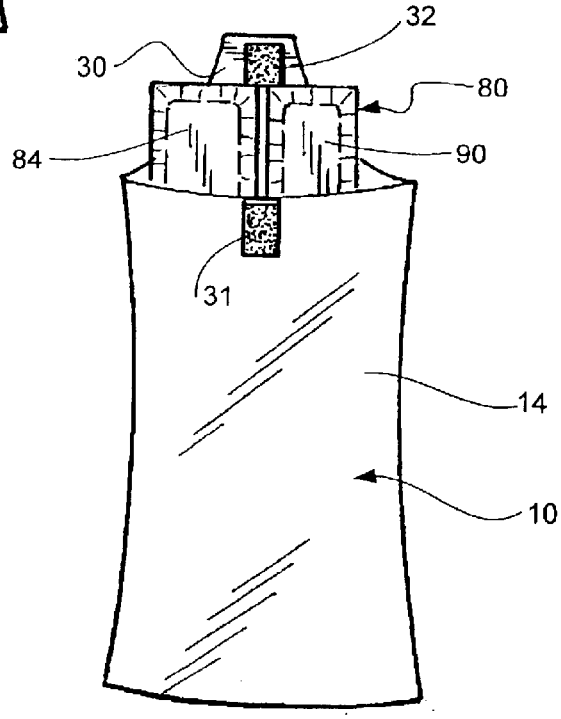
FIG. 5 is a view of the first side of the personal cooling device of the invention, featuring a coolant pack being inserted into or removed from the pouch component of the device via an open top end of the pouch.

As shown in FIGS. 4 and 5, the device of the invention 1 includes an elongated pouch member 10 configured to hold a coolant pack 80. The pouch 10 has an open upper end 12 and first 14 and second 16 opposing sides. The first 14 and the second 16 opposing sides have a flattened configuration, which serves both to hold a flattened coolant pack 80 and shield a user 200 from the rays of the sun. The pouch 10 is preferably made of a lightweight, breathable fabric. A lightweight fabric promotes low cost, convenience, and portability, unlike plastic, metal or other cooling devices.

As shown in FIG. 4, a suspension member 30 extends above the open upper end 12 of the second side 16 of the pouch 10. As shown in FIG. 4, the pouch 10 is provided with a first fastening means 31 fixed on an outer surface of the first side 14 of the pouch 10, adjacent the open upper end 12. As shown in FIG. 4, a second fastening means 32 is fixed on an inner surface of the suspension member 30. The first 31 and second 32 fastening means are configured to selectively attach to one another. In the embodiment illustrated hook and loop materials such as those sold under the trademark VELCRO® may be used. Alternatively, such fastening means as buttons and button holes, snaps, hooks and eyes and ties might also be utilized. As indicated in FIGS. 1, 2, 3 and 9, the second fastening means 32 is positioned such that when the second fastening means 32 attaches to the first fastening means 31, the suspension member 30 forms a loop 38 of sufficient length to suspend the pouch from the cap 100 via the strap 130 of the cap 100. In the alternative, fastening means 32 may operate directly with cap 100 as by attaching to strap 130 or the cap 100 directly with similar cooperative fastening means.

Figure 2:
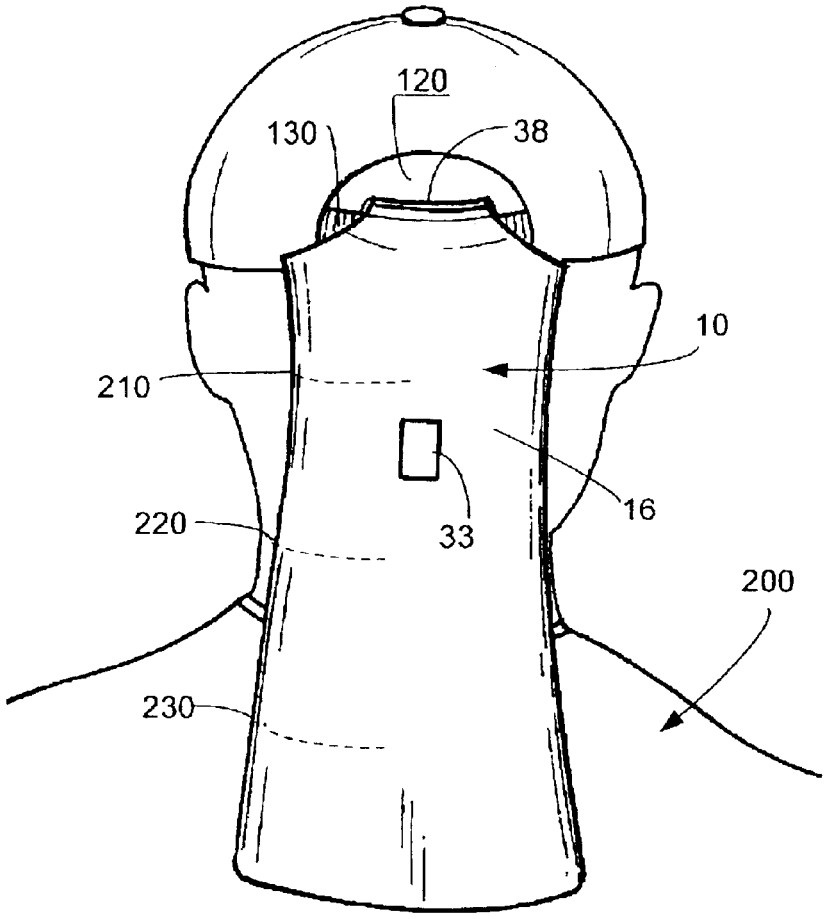
FIG. 2 is a rear view of one preferred embodiment of the personal cooling device of the invention suspended from the rear strap of a cap of a user of the device, featuring the device in a deployed configuration.

The pouch 10 is preferably about 4 inches wide but may vary from about 2 inches to about 6 inches wide in alternative embodiments, and about 3 to about 8 inches long, such that in the illustrated when the device 1 hangs from the rear strap 130 of the cap 100, at least a portion of the pouch 10 hangs along an upper back region 230 of a user, as well as along the rear of the head 210 and the nape of the neck 220 of the user, as indicated in FIG. 2. It should be understood that alternative embodiments of the cooling device 1 adapted for active movement by the wearer (such as when playing tennis) it is preferable that the hang of pouch 10 is shorter, such as about 3 to about 5 inches.

Figure 3:
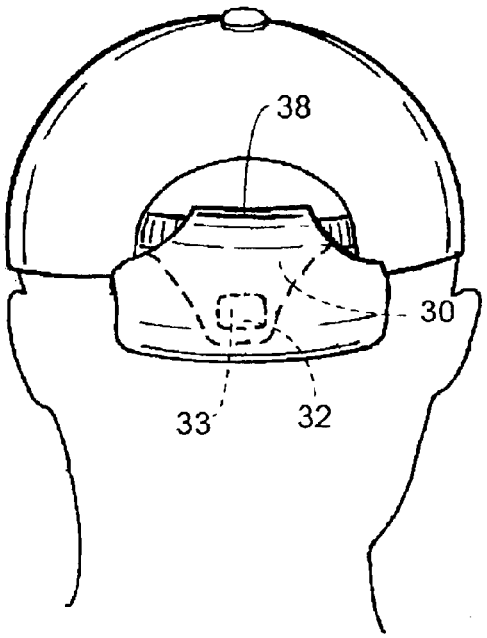
FIG. 3 is a rear view of the personal cooling device of FIG. 2, featuring the device in a rolled up configuration.
Figure 7:
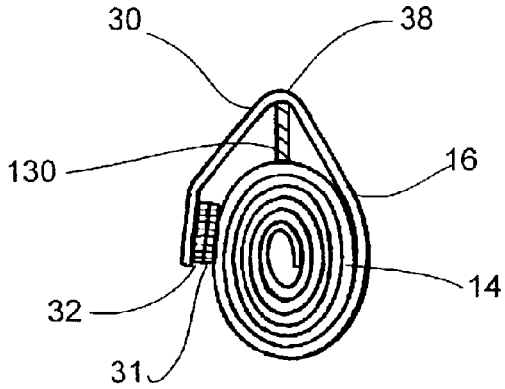
FIG. 7 is a side cross-section view of one preferred embodiment of the personal cooling device of the invention in a rolled-up configuration.

FIGS. 3 and 7 show the device 1 in a rolled-up configuration. The rolled-up configuration is preferably achieved by providing a third fastening means 33 fixed on an outer surface of the second side 16 of the pouch 10 (see FIGS. 2 and 9). The third fastening means 33 is configured to selectively attach to the second fastening means 32. The third fastening means 33 is positioned on the outer surface of the second side 16 of the pouch 10 such that when the coolant pack 80 is removed and the pouch 10 is rolled up along the first side 14, the second fastening means 32 may be selectively attached to the third fastening means 33 to thereby hold the pouch in a rolled configuration. FIG. 7 shows a side-cross section view of the pouch 10 rolled up and suspended from the rear strap 130 of a cap 100. As previously discussed, in addition to hook and loop fasteners, such fastening means as buttons and button holes, snaps, hooks and eyes and ties might also be utilized.

Figure 6:
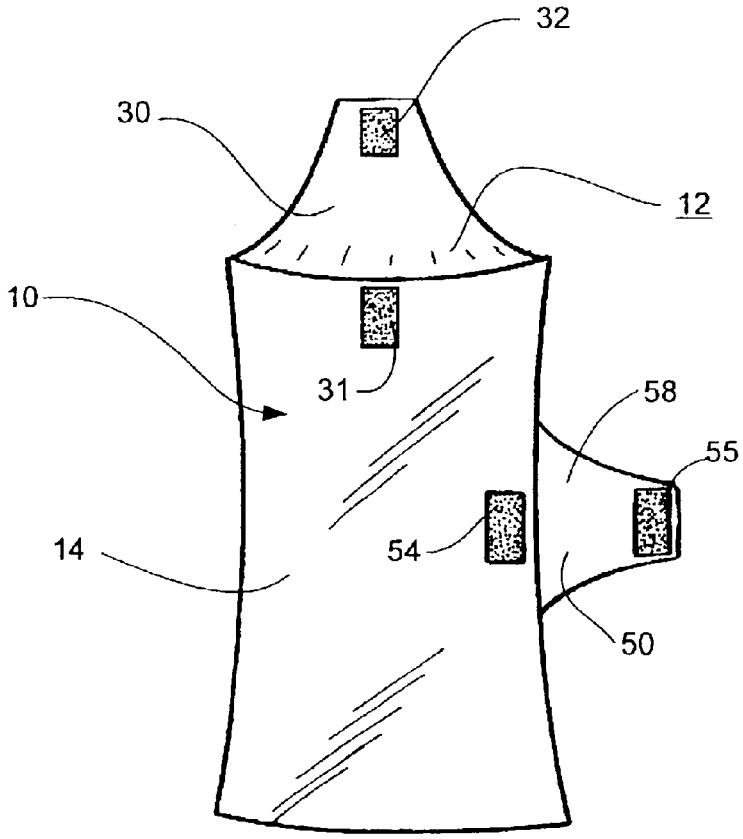
FIG. 6 is a frontal view of a first side of the personal cooling device of the invention, featuring a second suspension loop member located on the side of the pouch.

FIG. 6 shows an alternative preferred embodiment that provides a user 200 with the option of hanging the elongated pouch 10 from a cap 100 in either a vertical or horizontal position. The embodiment of FIG. 6 includes a second suspension member 50. The second suspension member 50 is configured similarly to the upper extension member 30, but the second suspension member 50 extends from a middle portion of the pouch 10. The second suspension member 50 extends between the first 14 and the second 16 sides of the pouch 10, such that when the second suspension member 50 is used to hang the pouch 10 in a horizontal configuration, the flattened surfaces of the first 14 and second 16 sides extend along the head 210 and neck 220 of a user.

As shown in FIG. 6, a fourth fastening means 54 and a fifth fastening means 55 are provided for use in hanging the pouch 10 from a cap 100 in a horizontal configuration. The fourth 54 and the fifth 55 fastening means are configured to selectively attach to one another. The fourth fastening means 54 is fixed on the pouch 10 adjacent a base of the second suspension member 50. The fifth fastening means 55 is fixed on an inner surface of the second suspension member 50, and is positioned such that when the fourth fastening means 54 attaches to the fifth fastening means 55, the second suspension member 50 forms a loop of sufficient length to suspend the pouch 10 from the cap 100 via the strap 130 of the cap 100.

The fastening means 31, 32, 33, 54, 55 are preferably strips of hook and loop materials such as that sold under the trademark VELCRO®. Hook and loop fasteners provide sufficient fastening strength to hold the pouch 10 and an enclosed coolant pack 80 on a strap 130 of a hat 100, while at the same time being easy to selectively fasten and unfasten. Hook and loop materials are also inexpensive and easy to apply to the pouch 10 during the manufacturing process. However, as previously discussed, other re-useable fastening means, such as snaps, buttons, zippers and the like can be used.

Conventional coolant packs 80 containing reusable coolant gels can be used in the pouch 10. However, a large bag of coolant gel suffers from the drawback that when the coolant warms up and passes into a liquid phase, the coolant gel tends to flow downward, resulting in pooling of fluid in the bottom of the coolant bag and less effective cooling at the top of the pouch 10. To prevent pooling, the coolant pack 100 preferably has a quilted configuration consisting of a plurality of closed compartments 90, as shown in the preferred embodiment of FIG. 8. Each closed compartment 90 encapsulates an amount of coolant, thus preventing the coolant from pooling in a lower portion of the coolant pack 100 upon warming of the coolant. FIG. 9 provides a cross-section view indicating how the closed compartments 90 prevent pooling of coolant in the bottom of the coolant pack 80.

Figure 8:
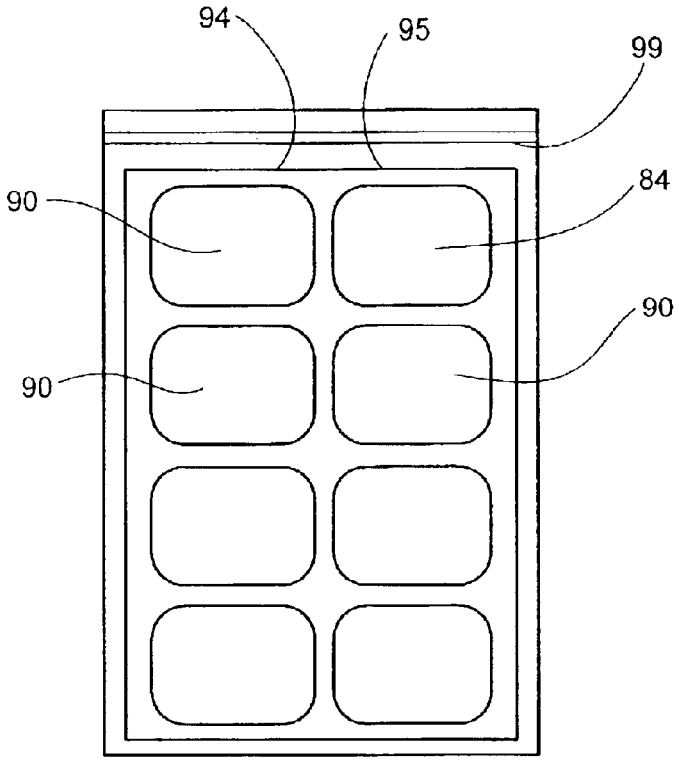
FIG. 8 is a front side view of one preferred embodiment of a coolant pack for insertion into the pouch component of the personal cooling device, featuring a plurality of closed compartments arranged in a pair of columns.
Figure 9:
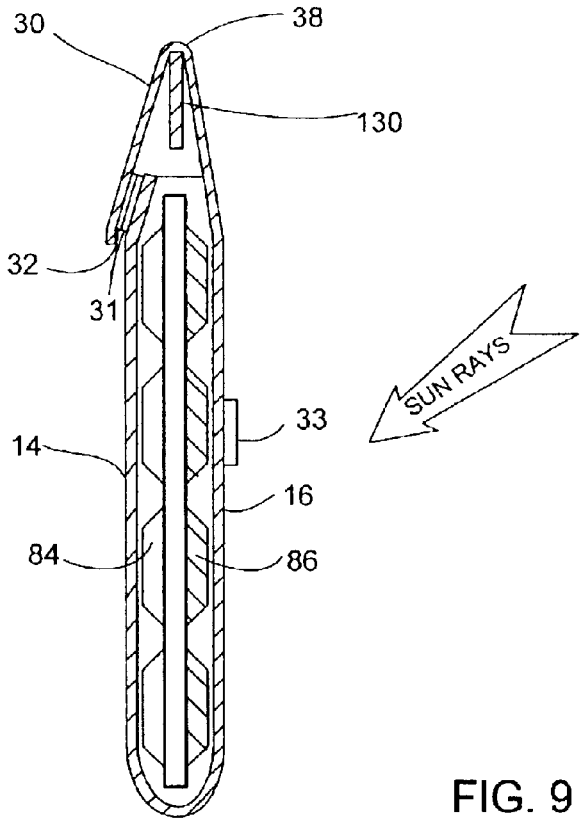
FIG. 9 is a side view cross-section of one preferred embodiment of the personal cooling device of the invention, featuring details of a coolant pack stored in the pouch component of the device.
Figure 10:
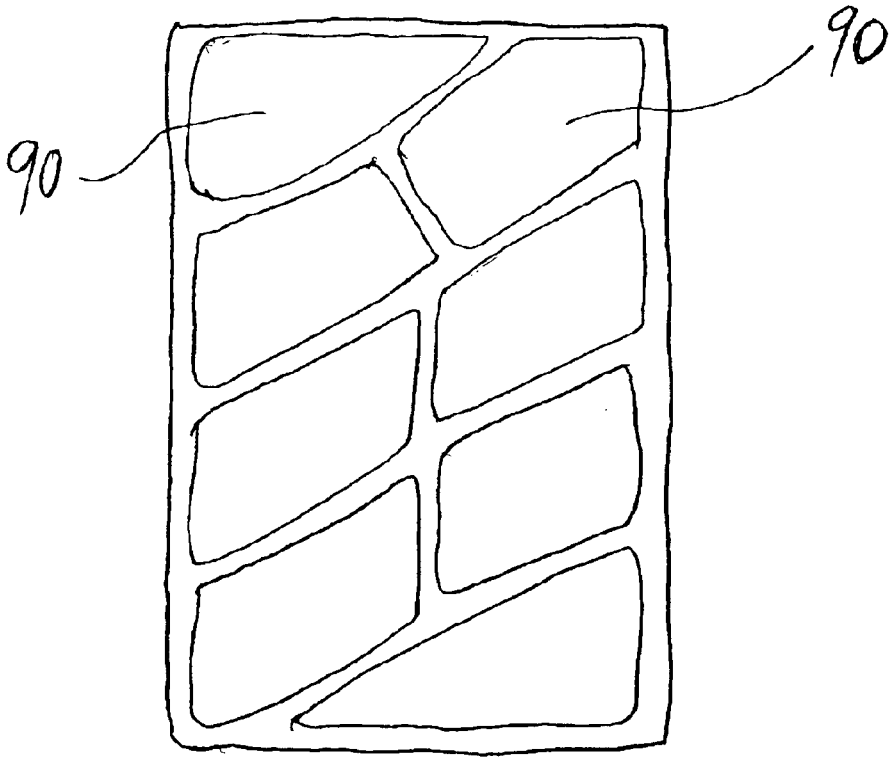
FIG. 10 is a front side view of one preferred embodiment of a coolant pack for insertion into the pouch compartment of the personal cooling device, featuring a plurality of closed compartments arranged at an oblique angle.

As shown in FIG. 8, the closed compartments 90 of the coolant pack 80 are preferably arranged in a pair of side-by-side vertical columns 94, 95. As indicted in FIG. 8, the coolant pack 80 preferably has at least eight closed compartments 90. It should be appreciated that the number and orientation of compartments 90 may be varied for the particular preferred application, as by number per row, number of rows, size of compartment, and vertical, horizontal or oblique axis.

In a preferred embodiment shown in FIG. 9, an inner side of the coolant pack 80 is composed of a heat conductive material 84, while an outer side of the coolant pack 80 has a reflective coating 86. The conductive side 84 facilitates transfer of heat from the user 200 to the coolant. The reflective coating 86 reflects sun rays, thus slowing down the rate at which the coolant pack 10 warms up during use. Acceptable coolant packs having a conductive 84 and a reflective 86 side can be obtained from suppliers of materials such as Lifelike Products, Inc. in sheet form and cut to size during manufacture of device 1, or might be specially fabricated for a particular model of device 1.

FIG. 8 shows the coolant pack 80 housed in a disposable polyethylene (poly) bag 99, such as a recloseable plastic bag sold under the trademark ZIPLOC®. As described in further detail below, the disposable poly bag 99 provides a means for providing hygienic exchange of coolant packs 80 at public events, such as sporting events or outdoor festivals. The poly bag 99 also shields a user from the condensation that builds up on the coolant pack 80 as it warms up.

As indicated in FIG. 1, to further the stylistic or promotional aspects of the invention 1, indicia 300 can be printed or embroidered on the pouch 10, such as the name or logo of a sports team, event or corporate sponsor. If the indicia 300 is provided on an upper part of the second side 16 of the pouch 10, the indicia will remain visible when the pouch 10 is in the rolled up configuration of FIG. 3. If promotional uses are intended, the personal cooling devices 1 can be distributed free of charge.

In operation, the device 1 is used by placing a cold or preferably frozen coolant pack 80 in the pouch 10 through the open upper end 12 of the pouch 10, draping the suspension member 30 over the rear strap 130 of a cap, and then locking the second fastening means 32 of the extension member 30 onto the first fastening means to thereby form the suspension loop 38 around the strap 130. The horizontal embodiment shown in FIG. 6 is used in a similar manner, except that the upper extension member 30 is used to hold the coolant pack 80 in the pouch 10, while the second suspension member 50 is used to form the suspension loop 38 around the strap 130. With the device 1 secured on the strap 130 of the 100, the cap 100 is then placed on the head 210 of a user 200, in the manner shown in FIGS. 1 and 2. The pouch 10 extends along the back of the head 210, toward the nape of the neck 220, and for the spectator version illustrated, preferably to the upper back 230 of the user 200, allowing the coolant pack 80 to cool the user 200. When the coolant pack 80 warms up and no longer provides a cooling sensation, it can be removed and replaced with a frozen coolant pack 80. A user may keep several coolant packs frozen in a refrigerator for this purpose, or, when venturing out in public, bring several frozen packs along in an ice chest. The coolant packs 80 can be readily transported to places where the availability of water and ice are limited.

The coolant pack 80 can be removed, refrozen, and reused. Because the coolant packs 80 and pouch 10 are reusable, the device 1 can be used in a method of doing business involving renting or selling of coolant packs 80. During events in hot weather, such as sports events, music festivals, fairs and the like, many participants wear baseball caps 100 or visors. In order to provide users 200 of these caps 100 with a personal cooling device 1, a plurality of the cooling devices 1 and coolant packs 80 can be stored at one or more vending locations at the event. The coolant packs 80 are frozen and stored in refrigerators or in ice chests at the vending location. If a user 200 does not have a portable cooling device 1, he or she can purchase a device 1 from the vending location. The user 200 can also purchase or rent a frozen coolant pack 80. The user 200 uses the coolant pack 80 until it no longer provides a cooling sensation, at which time the user 200 can return the coolant pack 80 to the vending location and exchange it for a frozen coolant pack 80. The vendor determines the price of the exchange. For example, a corporate sponsor of an event, such as a golf tournament, might exchange the packs for free, hoping to encourage widespread use of pouches 10 featuring the corporation's trademark. A sports stadium might charge an exchange fee adequate to make a profit and cover some of the overhead associated with hosting a sporting event.

By periodically exchanging warm packs 80 for frozen packs 80, users 200 of the device 1 can maintain a comfortable level of body temperature for an extended period of time and in a very convenient manner. In order to promote hygienic exchange of coolant packs 80, the packs 80 are preferably distributed inside of a disposable poly bag 99, as shown in FIG. 8. When the coolant pack 80 is returned to the vendor, the poly bag 99 is removed and discarded. The coolant pack is then refrozen, placed in a new poly bag 99, and later redistributed to a new user 200. The use of a poly bag 99 in conjunction with a coolant pack 80 and a pouch 10 enables the users 200 to exchange coolant packs 80 in a public area without concerns regarding adverse personal hygiene. The poly bags 99 allow each user 200 to re-stock the coolant pack 80 in his or her personal cooling device 1 without exposing it to bacteria or other hazards that may accumulate on another person's poly bag 99. The ability to re-freeze and exchange the coolant packs 80 in a public setting is a key feature of the invention.

The device 1 can be used in many leisure activities that typically take place in hot weather, such as baseball games, soccer games, automobile and motorcycle races, golf outings, beach activities, amusement parks, music festivals, and yard work. The device 1 can also be used in industrial applications, such as construction, road maintenance, home maintenance and farming. The device 1 can also be used for medical applications, such as treating heat stroke or injuries.

Although the present invention has been described in terms of specific embodiments, it is anticipated that alterations and modifications thereof will no doubt become apparent to those skilled in the art. It is therefore intended that the following claims be interpreted as covering all alterations and modifications that fall within the true spirit and scope of the invention.

What is claimed is:

1. A personal cooling device for use with a cap, such as a baseball cap or a visor, the cap having a strap extending across a rim region extending around the rear cap of the cap, said device comprising:

an elongated pouch member configured to hold a coolant pack, said pouch member having an open upper end and first and second opposing sides, said first and said second opposing sides having a flattened configuration, a suspension member extending above said open upper end of said second side of said pouch, a first fastening means and a second fastening means, said first and said second fastening means configured to selectively attach to one another;

said first fastening means fixed on an outer surface of said first side of said pouch adjacent said open upper end, and said second fastening means fixed on an inner surface of said suspension member, said second fastening means positioned such that when said second fastening means attaches to said first fastening means, said suspension member forms a loop of sufficient length to suspend said pouch from the cap via the strap of the cap; and a coolant pack in said elongated pouch member.

2. The device of claim 1, wherein said elongated pouch is about 2 to about 6 inches wide and between about 6 to 8 inches long, such that said device hangs downwardly from the rear of the cap, toward the nape of the neck of a user of the cap.

3. The device of claim 1, wherein said elongated pouch is about 4 inches wide and about 6 to about 8 inches long, such that when said device hangs downwardly from the rim of the cap, at least a portion of said pouch hangs over an upper back region of a user.

4. The device of claim 1, further comprising a third fastening means, said third fastening means configured to selectively attach to said second fastening means, said third fastening means fixed on an outer surface of said second side of said pouch, said third fastening means positioned such that when said coolant pack is removed and said pouch is rolled up along said first side, said second fastening means may be selectively attached to said third fastening means to thereby hold said pouch in a rolled-up configuration.

5. The device of claim 1, further comprising a second suspension member, said second suspension member extending from a middle portion of said pouch between said first and said second sides of said pouch, a fourth fastening means and a fifth fastening means, said fourth and said fifth fastening means configured to selectively attach to one another, said fourth fastening means fixed on said pouch adjacent a base of said second suspension member, said fifth fastening means fixed on an inner surface of said second suspension member, said fifth fastening means positioned such that when said fourth fastening means attaches to said fifth fastening means, said second suspension member forms a loop of sufficient length to suspend said pouch from the cap via the strap of the cap.

6. The device of claim 1, further comprising said coolant pack having a plurality of closed compartments, each said compartment encapsulating an amount of coolant, said compartments preventing said coolant from pooling in a lower portion of said coolant pack upon warming of said coolant.

7. The device of claim 6, wherein said closed compartments are arranged in a pair of side-by-side rows.

8. The device of claim 7, wherein said coolant pack has at least eight closed compartments.

9. A personal cooling device for use with a cap, such as a baseball cap or a visor, the cap having a strap extending across a rim region of the rear of the cap, said device comprising:

an elongated pouch member configured to hold a coolant pack, said pouch member having an open upper end and first and second opposing sides, said first and said second opposing sides having a flattened configuration, a suspension member extending above said open upper end of said second side of said pouch, a first fastening means and a second fastening means, said first and said second fastening means configured to selectively attach to one another, said first fastening means fixed on an outer surface of said first side of said pouch adjacent said open upper end, and said second fastening means fixed on an inner surface of said suspension member, said second fastening means positioned such that when said second fastening means attaches to said first fastening means, said suspension member forms a loop of sufficient length to suspend said pouch from the cap via the strap of the cap, a coolant pack in said elongated pouch member, said coolant pack having a plurality of closed compartments, each said compartment encapsulating an amount of coolant, said compartments preventing said coolant from pooling in a lower portion of said coolant pack upon warming of said coolant, an inner side of said coolant pack composed of a heat conductive material, and an outer side of said coolant pack having a reflective coating.

10. The device of claim 9, wherein said closed compartments are arranged in a pair of side-by-side vertical columns.

11. The device of claim 10, wherein said coolant pack has at least eight closed compartments.

12. The device of claim 9, said elongated pouch is about 4 inches wide and between about 6 to about 8 inches long, such that when said device hangs from the rear strap of the cap, at least a portion of said pouch hangs over an upper back region of a user.

13. The device of claim 9, further comprising a third fastening means, said third fastening means configured to selectively attach to said second fastening means, said third fastening means fixed on an outer surface of said second side of said pouch, said third fastening means positioned such that when said coolant pack is removed and said pouch is rolled up along said first side, said second fastening means may be selectively attached to said third fastening means to thereby hold said pouch in a rolled-up configuration.

14. The device of claim 9, further comprising a second suspension member, said second suspension member extending from a middle portion of said pouch between said first and said second sides of said pouch, a fourth fastening means and a fifth fastening means, said fourth and said fifth fastening means configured to selectively attach to one another, said fourth fastening means fixed on said pouch adjacent a base of said second suspension member, said fifth fastening means fixed on an inner surface of said second suspension member, said fifth fastening means positioned such that when said fourth fastening means attaches to said fifth fastening means, said second suspension member forms a loop of sufficient length to suspend said pouch from the cap via the strap.

15. The device of claim 7 wherein said rows are vertical.

16. The device of claim 7 wherein said rows are on an oblique angle.

* * * * *

UNITED STATES PATENT AND TRADEMARK OFFICE

CERTIFICATE OF CORRECTION

PATENT NO. : 6,857,134 B1
APPLICATION NO. : 10/320915
DATED : February 22, 2005
INVENTOR(S) : Jed Cowell It is certified that error appears in the above-identified patent and that said Letters Patent is hereby corrected as shown below:

Title Page should read
(76) Inventors: Jed Cowell, 7978 Curleybark Cove, Bartlett, TN (US) 38135
S. Michael Beavers, 3574 Glynn Carrol Cove, Bartlett, TN (US) 38133

Signed and Sealed this

Twenty-seventh Day of January, 2009

JOHN DOLL
*Acting Director of the United States Patent and Trademark Office*